US005382944A

United States Patent [19]

Dipoala et al.

[11] Patent Number: 5,382,944

[45] Date of Patent: Jan. 17, 1995

[54] SUPERVISED PIR MOTION-DETECTION SYSTEM

[75] Inventors: William S. Dipoala, Fairport; David B. Lederer, Sodus Point, both of N.Y.

[73] Assignee: Detection Systems, Inc., Fairport, N.Y.

[21] Appl. No.: 924,958

[22] Filed: Aug. 5, 1992

[51] Int. Cl.[6] ..... G08B 13/18

[52] U.S. Cl. ..... 340/567; 340/514

[58] Field of Search ..... 340/567, 506, 514–516, 340/309.15, 587, 661; 250/338, 342, 252.1, 493.1, 495.1, 504 R

[56] References Cited

U.S. PATENT DOCUMENTS

| | | | |
|---|---|---|---|
| 3,928,849 | 12/1975 | Schwarz | 340/567 X |
| 4,560,874 | 12/1985 | Cinzori et al. | 250/342 X |
| 4,710,629 | 12/1987 | Müller et al. | 250/342 |
| 4,743,886 | 5/1988 | Steiner et al. | 340/514 |
| 4,922,116 | 5/1990 | Grinberg et al. | 250/495.1 |
| 5,093,656 | 3/1992 | Dipoala | 340/567 X |
| 5,151,682 | 9/1992 | Marinitsch | 340/514 |

*Primary Examiner*—Jeffery A. Hofsass
*Assistant Examiner*—Thomas J. Mullen, Jr.
*Attorney, Agent, or Firm*—Warren W. Kurz

[57] ABSTRACT

A passive infrared motion detection system is provided with means for detecting increases and/or decreases in the sensor or system sensitivity by a predetermined amount vis-a-vis a nominal level. Various schemes are disclosed for implementing this concept.

7 Claims, 2 Drawing Sheets

SUPERVISED PIR MOTION-DETECTION SYSTEM

BACKGROUND OF THE INVENTION

The present invention relates to improvements in motion-detection systems of the PIR (passive infrared radiation) variety. More particularly, it relates to apparatus for supervising a PIR motion-detection system to alert the system user of a change in sensitivity of the IR-sensing component.

It is well known in the art to detect the presence of an intruder (or pedestrian) in a region under surveillance by detecting a change in ambient temperature caused by the intruder's own body heat. Infrared detection systems of this type typically comprise a pyroelectric sensor, spectrally tuned to a wavelength of about 10 microns, and an optical system for focusing radiation from different fields of view onto the sensor. The sensor itself commonly comprises two or more IR-sensitive elements which are spaced apart and, together with the optical system, define a plurality of narrow fields of view. As the intruder passes through these fields of view, each element produces a signal which, ideally, is suitably processed to detect only the object of interest, thereby avoiding false alarms.

PIR systems of the above type are "passive" in nature in that they rely only on the IR energy produced by the object of interest to produce an alarm. Unlike microwave, ultrasonic and photoelectric detection systems which actively transmit energy into a region of interest and look for intruder-produced changes in the frequency and/or level of such energy, one cannot readily monitor or "supervise" the operability of a PIR system by passively monitoring the output of such systems. In PIR detection systems, there is no output until a target (i.e., an IR transmitter) enters the system's field of view. Thus, to assure that a PIR system is indeed functional, one must actively simulate a target of interest and determine whether an alarm signal is produced in response to that target. It is known, for example, to simulate a target by periodically irradiating a PIR sensor with a heating element, a light-emitting diode (LED) or a light bulb. See, for example, the disclosures of my commonly assigned U.S. Pat. No. 5,093,656, as well as the disclosure of U.S. Pat. No. 3,928,849, issued to F. Schwarz.

The "active" supervisory schemes described in the above patent references are designed to detect only a catastrophic failure of the system, as may be occasioned by a broken wire or a non-functioning system component. They are neither designed nor intended to detect a change (either increase or decrease) in the system sensitivity so as to signal a change in detection range of the system. Not having this capability can be problematic. For example, an unexpected increase in system sensitivity, as may occur with a change in amplifier gain, will give rise to an increased detection range and attendant false alarms. On the other hand, a decrease in sensitivity, as may result from a degrading sensor or electrical components, results in a reduced detection range and a corresponding loss of protection. Often, it is desirable to produce a "trouble" signal when the system sensitivity has changed by a predetermined amount vis-a-vis a nominal level.

SUMMARY OF THE INVENTION

In view of the foregoing discussion, an object of this invention is to provide a PIR detection system which is supervised to detect a predetermined change, either increase or decrease, in system sensitivity.

According to the invention, a passive infrared radiation detection system of the type comprising a pyroelectric sensor adapted to produce an output signal in response to being irradiated with infrared radiation, is provided with supervision means for producing a "trouble" alarm in response to detecting that the system sensitivity has either increased or a decreased by a predetermined amount vis-a-vis a nominal sensitivity level. To determine such a change in sensitivity, various schemes are disclosed for selectively irradiating the sensor element for either different time periods or at different intensity levels. Circuit means are provided for comparing the sensor output to different threshold levels.

Other objects and advantages of the invention will be apparent to those skilled in the art from the ensuing detailed description of preferred embodiments, reference being made to the accompanying drawings wherein like reference characters denote like parts.

DETAILED DESCRIPTION OF PREFERRED EMBODIMENTS

Figure 1:
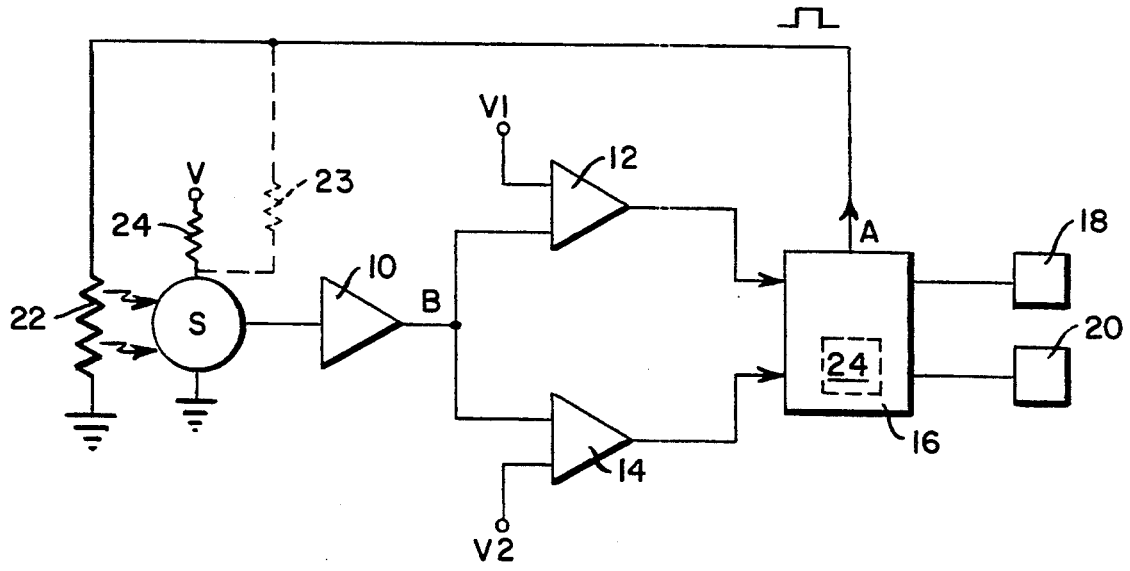
FIG. 1 is a schematic illustration of a preferred PIR detection system embodying the supervisory apparatus of the invention.

Referring now to the drawings, FIG. 1 illustrates a PIR detection system comprising a conventional PIR sensor S which is positioned to be irradiated by infrared radiation IR emanating in a region under surveillance. Such radiation is provided, for example, by the human body passing through the field of the sensor. Sensor S typically comprises a pair of IR-sensitive pyroelectric elements which are spaced apart to define two different fields of view. These elements are commonly connected in series opposition so that the sensor output is positive-going with respect to a reference level when one element is irradiated, and negative-going with respect to the same reference level when the other element is irradiated. The output of the sensor is passed through an amplifier 10, and the amplified output is applied to a pair of differential amplifiers or comparators 12, 14 which are connected to reference voltages V1 and V2, respectively. The respective outputs of the comparators are applied to a suitably programmed microprocessor 16 which operates, in a well known manner, to process the input signals to discriminate against transients and other false alarm-producing signals. In the event the microprocessor determines that the input signals are representative of a target of interest (e.g., an unauthorized person or pedestrian), it produces a signal to energize an alarm relay 18. The operation of the PIR system in detecting human targets is well known and need not be described herein inasmuch as it is not necessary for a thorough understanding of the present invention.

Figure 2:
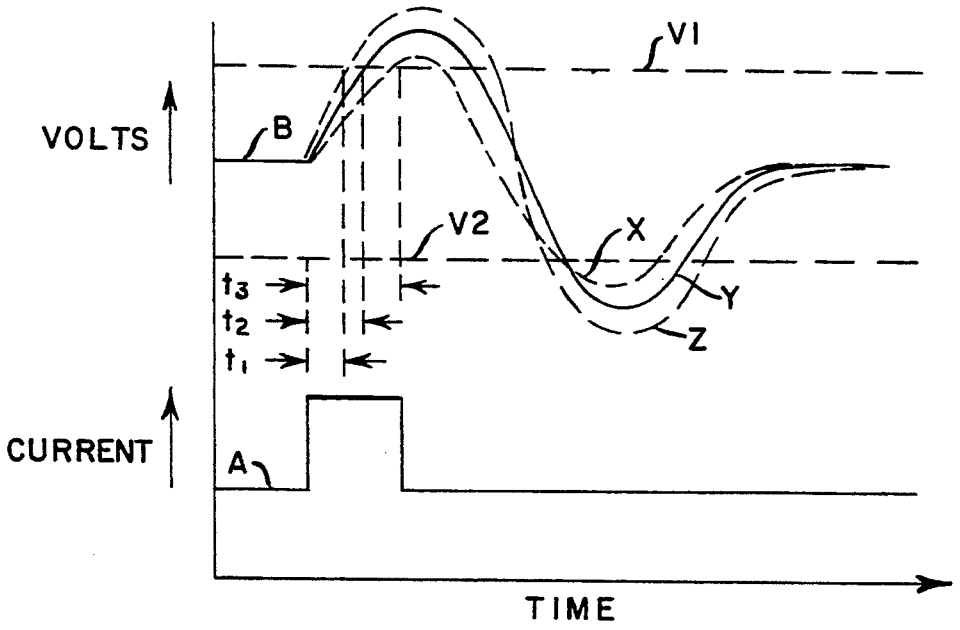
FIG. 2 is a representation of possible waveforms developed at different points in the circuit of FIG. 1.

Now in accordance with the present invention, there is provided a method and apparatus for activating a "trouble" alarm 20 in the event the system sensitivity increases or decreases by a predetermined amount (e.g., by 50%) with respect to a nominal sensitivity level. To achieve this end in the FIG. 1 system, microprocessor 16 is used to produce an output A in the form of a current pulse P (shown in FIG. 2) having a fixed amplitude. This current pulse, which is periodically produced, for example, only once every 12 hours to avoid any significant disruption in the service provided by the system, is applied to a conventional "surface mount" resistor 22 which is positioned to irradiate sensor S. Upon being radiated by resistor 22, sensor S produces an amplified output B which, depending on the sensitivity of the sensor, may appear as any of the waveforms X, Y or Z shown in FIG. 2. Microprocessor 16 is programmed to determine the response times T1 or T3, measured from the time the current pulse is initiated and the time the output of amplifier 10 crosses the first threshold set by either reference voltages V1 or V2. This response time is then compared with a nominal response time T2. If the measured response time is shorter than the nominal time by a preset amount, then the system is too sensitive, and a "trouble" alarm is activated by the microprocessor. If, on the other hand, the measured response time is longer than the nominal response time by a preset amount, the system sensitivity is considered too low, and again a trouble alarm is activated. The nominal response time is determined during a calibration test on each unit. This time period is stored in an EEPROM 22 which forms a part of the microprocessor.

Figure 3:
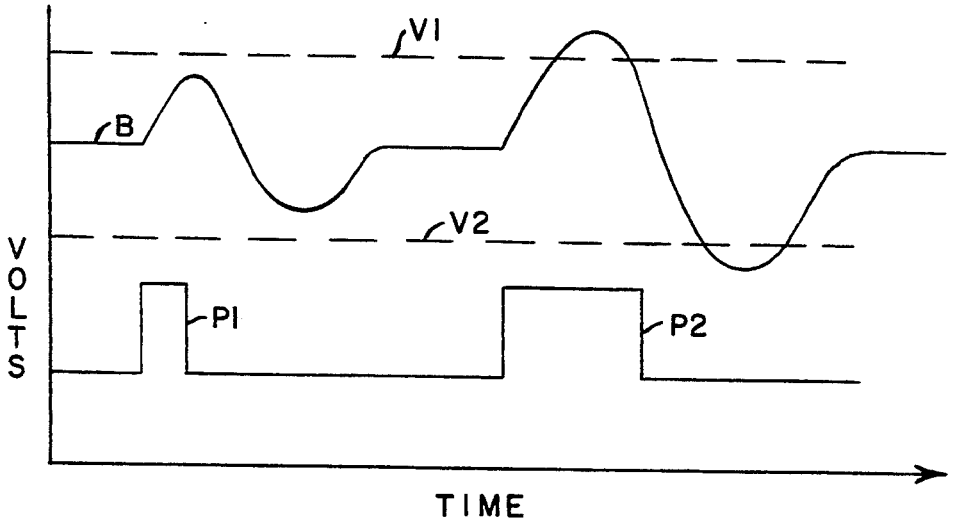
FIG. 3 are waveforms illustrating the response of the PIR sensor to two stimuli of the same amplitude but of different duration.

A similar approach to that of FIG. 1 is shown in FIG. 3 in which the microprocessor successively applies two different current pulses P1 and P2 to resistor 22, one pulse being, for example, twice as long as the other. Ideally, the duration of the short pulse is such that output B will not cross either threshold. If it does, the system is too sensitive. Similarly, the duration of the longer pulse is such that it will cause output B to cross either or both of the thresholds set by voltages V1 and V2, If it does not, then the system sensitivity is too low. Of course, by merely adjusting the pulsewidths, the fractional change in sensitivity (vis-a-vis a nominal level) required to activate the "trouble" alarm can be easily adjusted.

Figure 4:
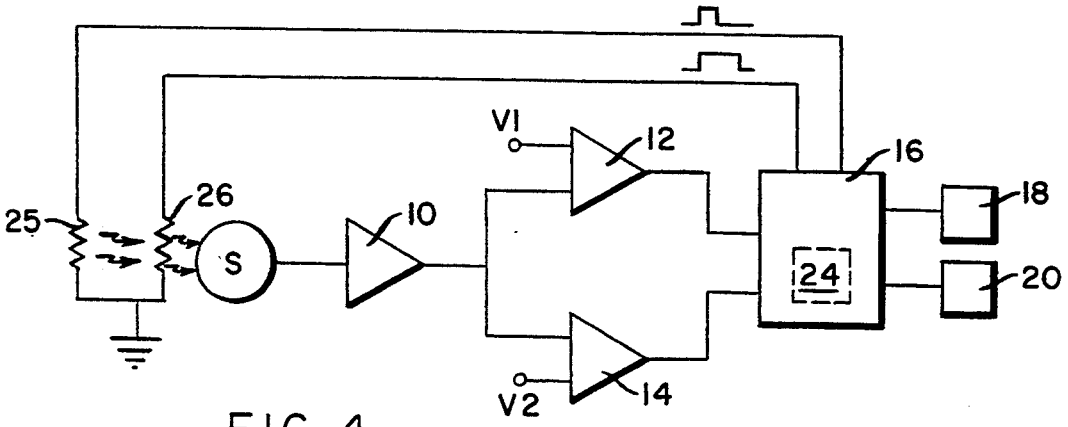
FIGS. 4 and 5 illustrate alternative embodiments of the invention.

In the embodiment shown in FIG. 4, two resistors 25 and 26 are used to simulate strong and weak targets. In this case, if the resistors are of the same value and thereby produce substantially the same radiant energy for the same energizing current pulse, strong and weak targets can be simulated by positioning one resistor closer to the sensor than the other, and/or applying current pulses of different pulse length to the resistors, as illustrated. If the resistors are of different values, the same current pulse width can be applied to each, and the can be at the same distance from the sensor.

Figure 5:
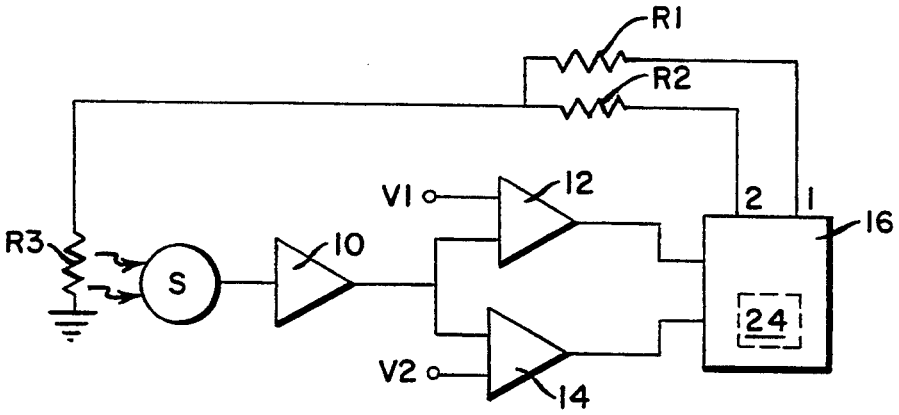

In FIG. 5, another variation for sequentially simulating strong and weak targets is illustrated. Here, the power radiant energy radiated by the target resistor R3 is controlled by changing the output states of outputs 1 and 2 of the microprocessor. A strong target is simulated by resistor R3 when both outputs are "high". On the other hand, a weak target is simulated when only one or the other of the microprocessor outputs goes high. A voltage divider network comprising resistors R1 and R2 serve to provide current pulses of different amplitude to the target resistor R3.

In all of the sensitivity-sensing schemes disclosed above, it is desirable to program the microprocessor so that a "trouble" alarm is produced only after the system fails the supervisory test several times in a row. This technique is used because a "walk" signal (produced when the system is either armed or disarmed) may cancel out a test signal, and/or confuse the response time measurement (in the FIG. 1 embodiment).

When a resistor element is used to simulate a test target, there are three variables that vary the amount of radiant energy seen by the sensor: 1) the power P dissipated by the resistor, where $P=E^2/R$, and where E is the applied voltage and R the resistance value of the resistor; 2) the distance between the resistor and the sensor; and 3) the emissivity of the resistor. As noted above, a surface mount resistor provides the most signal for a given power level and distance.

An alternative to using a resistive element to irradiate the sensor element to ascertain system operability, output A from the microprocessor can be applied to the sensor bias resistor 24 via resistor 23, shown in phantom line in FIG. 1. An advantage of this approach is that it provides active supervision of the amplifier and all signal processing circuitry when, owing to the optical design, for example, it is mechanically difficult to position a heater resistor in front of the sensor. The disadvantage, of course, is that the sensor itself is not supervised.

The invention has been described with particular reference to preferred embodiments. It will be appreciated, however, that numerous modifications and variations can be made without departing from the true spirit of the invention. Such modifications and variations are intended to fall within the scope of the appended claim.

What is claimed is:

1. In a passive infrared radiation detection system comprising a pyroelectric sensor for producing an output signal in response to being irradiated with infrared radiation, the improvement comprising:

means for detecting a change in sensitivity of said pyroelectric sensor by a predetermined fraction of a nominal sensitivity level, said detecting means comprising a resistor positioned in close proximity to said sensor, and means for sequentially applying current pulses of different amplitudes to said resistor, said current pulse applying means comprising logic means having first and second output terminals on which said current pulses are produced in the form of binary signals, said terminals being connected to said resistor through a voltage dividing network, whereby the amplitude of said current pulses is controlled; and means responsive to said detecting means for providing an indication that said change has been detected.

2. The apparatus as defined by claim 1 wherein said detecting means comprises means for sensing an increase in sensitivity of said pyroelectric sensor with respect to an initial nominal sensitivity level.

3. The apparatus as defined by claim 1 wherein said detecting means comprises means for sensing a decrease in sensitivity of said pyroelectric sensor with respect to an initial nominal sensitivity level.

4. In a passive infrared radiation detection system comprising a pyroelectric sensor for producing an output signal in response to either the sensor being irradiated with infrared radiation, or an electrical signal being applied to a bias resistor connected to the sensor, and circuit means for processing said output signal to distinguish said output signal from signals produced by spurious sources, said system having a sensitivity determined by certain characteristics of the sensor and circuit means, the improvement comprising:

means for detecting a change in sensitivity of said system by a predetermined fraction of a nominal sensitivity level, said detecting means comprising means for applying an electrical impulse signal to said bias resistor, means for determining the response time required for said output signal to reach a predetermined threshold level, and means for comparing said response time to a nominal response time characteristic of a nominal sensor sensitivity level; and means responsive to said detecting means for providing an indication that said change has been detected.

5. In a passive infrared radiation detection system comprising a pyroelectric sensor for producing an output signal in response to being irradiated with infrared radiation, the improvement comprising:

means for detecting predetermined increases and decreases in the sensitivity of said pyroelectric sensor, said detecting means comprising (i) means for suddenly irradiating said sensor with infrared radiation at a predetermined level, said irradiating means comprising an electrical resistor positioned in close proximity to said sensor, and means for applying a current pulse to said resistor to cause said resistor to radiate infrared radiation, and (ii) means for determining the response time required for said output signal to reach a predetermined threshold level, said determining means comprising means for comparing said response time to a nominal response time characteristic of a nominal sensor sensitivity level; and means responsive to said detecting means for providing an indication that either an increase or decrease in sensitivity has been detected.

6. In a passive infrared radiation detection system comprising a pyroelectric sensor for producing an output signal in response to being irradiated with infrared radiation, the improvement comprising:

means for detecting a change in sensitivity of said pyroelectric sensor by a predetermined fraction of a nominal sensitivity level, said detecting means comprising a pair of resistors positioned in close proximity to said sensor, and means for sequentially applying current pulses of different level and/or duration to said resistors to cause said resistors to differentially irradiate said sensor; and means responsive to said detecting means for providing an indication that said change has been detected.

7. In a passive infrared radiation detection system comprising a pyroelectric sensor for producing an output signal in response to being irradiated with infrared radiation, the improvement comprising:

means for detecting a change in sensitivity of said pyroelectric sensor by a predetermined fraction of a nominal sensitivity level, said detecting means comprising a pair of resistors positioned in close proximity to said sensor, one resistor being closer to said sensor than the other, and means for sequentially applying identical current pulses to said resistors to cause said resistors to differentially irradiate said sensor; and means responsive to said detecting means for providing an indication that said change has been detected.

* * * * *